US005805664A

United States Patent [19]

Whipple, III et al.

[11] Patent Number: 5,805,664

[45] Date of Patent: Sep. 8, 1998

[54] IMAGER CONTROL SYSTEM WITH CONTACT DETECTOR

[75] Inventors: Walter Whipple, III, Amsterdam; Vivek Venugopal Badami, Niskayuna, both of N.Y.

[73] Assignee: General Electric Company, Schenectady, N.Y.

[21] Appl. No.: 537,580

[22] Filed: Oct. 2, 1995

[51] Int. Cl.[6] ..... H05G 1/08

[52] U.S. Cl. ..... 378/117; 378/91

[58] Field of Search ..... 378/117, 91

[56] References Cited

U.S. PATENT DOCUMENTS

| | | | |
|---|---|---|---|
| 4,127,775 | 11/1978 | Ohlson | 250/490 |
| 4,320,766 | 3/1982 | Alihanka et al. | 128/671 |
| 5,019,804 | 5/1991 | Fraden | 340/562 |
| 5,097,495 | 3/1992 | Gray et al. | 378/117 |
| 5,105,455 | 4/1992 | Kato et al. | 378/117 |
| 5,485,502 | 1/1996 | Hinton et al. | 378/117 |
| 5,486,700 | 1/1996 | Silberklang et al. | 250/363.04 |

*Primary Examiner*—Craig E. Church
*Attorney, Agent, or Firm*—Donald S. Ingraham; Douglas E. Stoner

[57] ABSTRACT

An imager control system with contact detection capability for positioning a movable imaging element structure with respect to a subject includes a collar assembly disposed around at least a portion of the imaging element structure disposed towards a subject region; a plurality of sensor elements disposed in a sensing pattern in the collar assembly, each sensor element having a number elastomeric electrodes coupled together in series; and a processing unit coupled to the sensor elements so as to detect contact between the collar assembly and a subject of examination as a function of a change in resistance in one or more elastomeric electrode resulting from deformation of the electrode upon contact with the subject. The elastomeric electrodes are made of a flexible material in which conductive particles have been embedded such that electrode exhibits a change in electrical resistance in response to physical deformation.

9 Claims, 2 Drawing Sheets

IMAGER CONTROL SYSTEM WITH CONTACT DETECTOR

BACKGROUND OF THE INVENTION

This invention relates generally to radiation imaging devices with movable components and in particular to safety systems for controlling the movable components of an imaging system to minimize harm to a subject of examination in the event of contact.

Medical radiation imagers, such as x-ray machines, must be accurately positioned close to the patient to provide the desired imaging information and such that components of the assembly do not physically collide with the patient. On some types of imaging equipment, such as computer tomography (CT) imagers or the like, a radiation detector, such as an x-ray image intensifier tube is positioned on a movable gantry arm opposite to another arm on which the x-ray source is disposed; the opposed arms can be swung 360° around a part of a patient's body, such as the head. It is desirable that the radiation detector be positioned close to (e.g., within about 1 inch) but not touch any part of the patient as the gantry arm rotates. In such systems an operator commonly controls the position of the radiation detector by means of manual control, such as with a joystick arrangement. The end of the radiation detector assembly nearest the patient is surrounded by a donut-shaped air-bag assembly. In what is commonly called "Level I" sensing, if the air-bag assembly comes in contact with the patient, a detected change in air pressure in the air-bag causes the control system to direct cessation of movement of the system. A pressure difference of about 0.3" of water is commonly used as the threshold to prompt a Level I stop. A second level of sensing, Level II sensing, refers to a situation when an additional 0.1" change (beyond Level I) in air-bag pressure occurs, such as from slight over-travel in the gantry arm after reaching the Level I shutdown point. A Level II signal causes a complete motor shutdown and locking of the gantry arms; the Level II motor control is accomplished via hard-wired relays outside of the normal computer-controlled gantry arm control circuits. After a Level II shutdown signal, the gantry arm assembly must be manually disengaged and hand-cranked away from the patient's body. This arrangement provides a dual-point failure mode in the sensing scheme. Most systems further have a contact switch disposed exterior to the air bag that provides a further back up, such that physical contact resulting in activation of the contact micro-switches provides independent shutdown signals to the gantry arm control system.

Efficient and effective use of medical imaging equipment of this type is enhanced by operating modalities that follow the contour of the patient's body to maintain the radiation detector assembly at a desired separation from the nearest portion of the patient's body as the assembly is rotated around the body. It is desirable that no part of the radiation detector assembly and gantry arm come into contact with the patient's body at any time during the procedure, and further desirable that the control system be able to prevent contact with the patient and shutdown commands that are generated as a result of contact with the air-bag assembly disposed around the radiation detector.

SUMMARY OF THE INVENTION

In accordance with this invention, a ranging system for positioning a movable imaging element structure with respect to a subject of examination includes a collar assembly disposed around at least a portion of the imaging element structure that is oriented towards an imaging region; a plurality of contact sensor elements disposed in a sensing pattern in the collar assembly; and a processing unit. Each sensor element is made up of a plurality of segments of elastomeric electrodes electrically coupled together in series. The processing unit is coupled to the sensor elements so as to generate a subject contact signal in correspondence as a function of changes in electrical characteristics of the elastomeric electrodes resulting from deformation of elastomeric electrodes in the sensor elements when the collar assembly contacts the subject. The sensor elements typically further serve as capacitive sensor plates and the processor is adapted to generate a range signal corresponding to the proximity of the sensor elements to the subject as a function of the capacitance between the sensor plates and the subject. The elastomeric electrodes typically are made of a flexible (or deformable) material such as silicone impregnated with conductive particles such that it exhibits a change in electrical resistance in response to deformation of the elastomeric electrode.

The respective sensor elements are typically coupled to the processing unit via a multiplexer so that one or more separate sensor elements can be coupled together to form a contact localization sensing arrangements. The sensor elements are disposed in the collar assembly so that upon contact between the collar assembly and the subject, deformation of elastomeric electrodes in one or more respective contact localization sensing arrangement results in electrical resistance changes detected by the processor unit so that a subject contact signal can be generated corresponding to the location of contact between the collar assembly and the subject.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
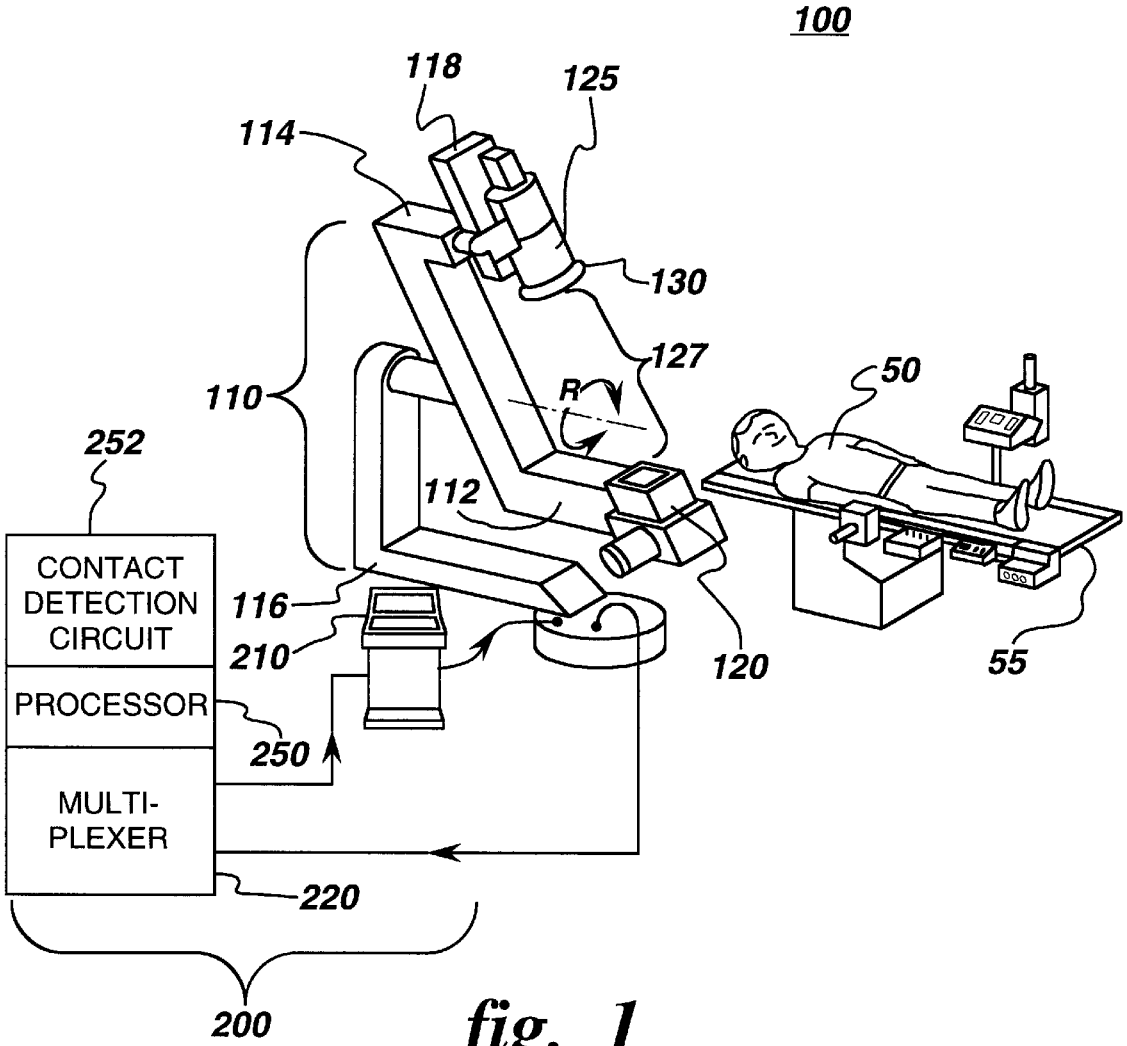
FIG. 1 is a part perspective and part block diagram of a radiation imaging system having a capacitive ranging system in accordance with this invention.

A radiation imaging system 100 comprises a movable gantry assembly 110 on which components of the imaging system are disposed. An imager control system 200 (FIG. 1) is coupled to gantry assembly 110 so as to govern operation of the moving components. Control system 200 comprises an operator console 210 for commanding respective modalities of operation of imaging system 100, a plurality of contact sensor elements 270 (FIG. 2) disposed in a collar assembly 130 (FIG. 1) on gantry assembly 110, and a processing unit (or processor) 250 having a contact detection circuit 252. Processor 250 is coupled to sensor elements 270 so as to detect contact between collar assembly 130 and a subject of examination 50 so that control signals can be generated stop movement of gantry assembly 110 an to disengage the gantry assembly from contact with the subject.

By way of example, and not limitation, imager control system 200 typically further is adapted to comprise a capacitive ranging system in which each sensor element 270 is further adapted to serve as a capacitive sensor element, and processing unit 250 is adapted to generate a range signal corresponding to the capacitance between sensor elements and a subject of examination 50 (e.g., the object being imaged), for example as is described in copending application entitled "Capacitive Proximity Detector For Radiation Source Position Control", Ser. No. 08/537,954 (RD-20,582), which is assigned to the assignee herein and incorporated by reference. In such an arrangement processor 250 further generates control signals corresponding to the proximity of components on gantry assembly 110 to a subject 50 so as to move gantry assembly 110 to a desired position with respect to the imaged object.

Gantry assembly 110 comprises a first arm 112 and a second arm 114 that provide a support structure for components of the radiation imaging system. Typically a radiation source 120 (such as an x-ray source or the like) is mounted on first arm 112 and radiation detector assembly 125, such as an x-ray image-intensifier tube (II-tube), is disposed on second arm 114 so as to be disposed opposite radiation source 120 across an intervening imaging region 127.

By way of example and not limitation, as presented herein radiation imaging system 100 is adapted for medical imaging of a patient's body; alternatively, the control system with contact detection of this invention can be used with other types of radiation imaging, such as is used in industrial processes for quality control and the like. Typically subject 50 is a portion of a patient's body, such as the patient's head, that is resting on an examining table 55. Gantry arms 112 and 114 are rotatably mounted on a gantry foundation 116 so that they can be rotated around subject 50, e.g., as indicated by the arrow "R" in FIG. 1. II-tube 125 is further mounted on a movable slide 118 so that it can be disposed closer to or farther from radiation source 120, thus respectively decreasing or increasing the extent (or length between the source and detector components) of imaging region 127. Gantry assembly 110 and movable components thereon, such as slide 118, are typically driven by drive systems (not shown), such as an electrical motor and transmission, that are responsive to signals from control system 200.

When initially positioning the patient within imaging region 127, slide 118 is positioned to provide a large extent of imaging region 127; during the x-ray examination procedure, however, it is desirable that radiation detector 125 be positioned in close proximity to subject 50, but not in continuous physical contact with the subject. A collar assembly 130 is typically disposed around the end or portion of radiation detector 125 that is closest to the surface of subject 50.

Control system 200 that is adapted to provide capacitive range signals typically further comprises a multiplexer 220 through which sensor elements 270 are coupled to processor 250. Capacitive ranging control system 200 is coupled to radiation imaging system 100 so as to sense the position of radiation detector assembly 125 (FIG. 1) with respect to subject 50 and to generate signals to control the movement of gantry assembly 110 and components thereon (such as movable slide 118) to dispose radiation detector 125 in a desired location with respect to subject 50. Typically ranging system 200 provides accurate and contemporaneous proximity sensing sensitivity so that signals can be generated by control console 210 to position movable slide 118 (and thus radiation detector 125) automatically during an imaging process as gantry assembly 110 rotates around subject 50, thus reducing the time and inaccuracy associated with manual positioning of the gantry arm assembly with respect to subject 50 during an imaging process.

Figure 2:
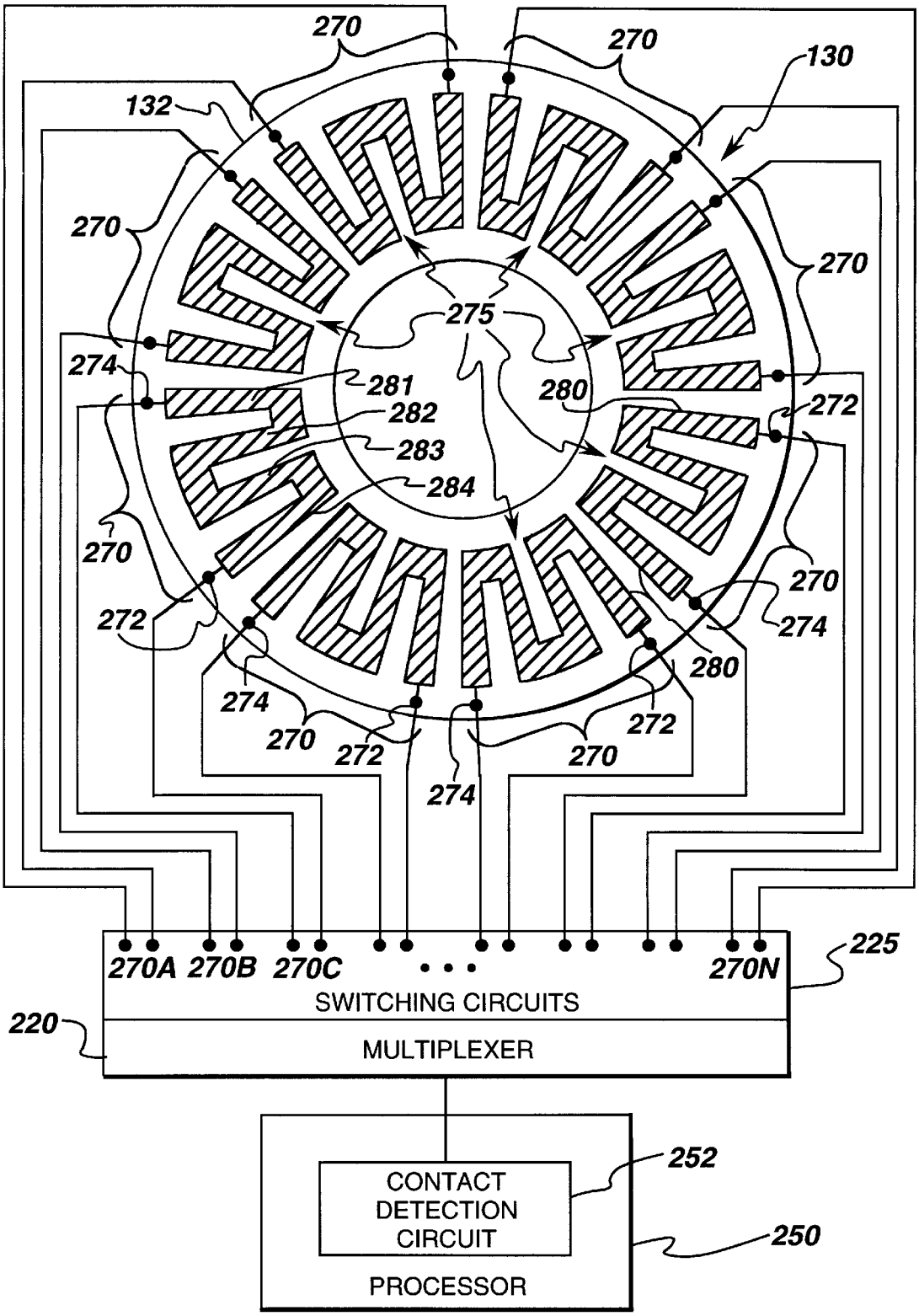
FIG. 2 is a part schematic and part cross-sectional view of a collar assembly having a contact detection system in accordance with this invention.

In accordance with this invention, control system 200 comprises a plurality of sensor elements 270 that are disposed around collar assembly 130, as illustrated in the cross-sectional view of collar assembly 130 in FIG. 2. Collar assembly 130 is typically donut-shaped, that is, having a circular tube-type structure. For purposes of illustration only, eight sensor elements 270 are illustrated; as noted below, the number of sensor elements in a given installation may be greater or smaller, and this potential for variation is noted by use of 270N as the contact designation for the last of the sensor elements. Each sensor element is coupled to processor 250, typically via multiplexer 220 through respective electrical leads 272, 274 so as to be selectively coupled together by switching circuits 225 in multiplexer 220 in one of plurality of sensing range modality switching units that provide different range detecting sensitivities.

Each sensor element 270 comprises a plurality of elastomeric electrodes 280 that are coupled together in series. As used herein, "elastomeric" and the like refers to electrodes that are capable of some degree of physical deformation, which deformation results in a change in the electrical resistance of the electrode. The change in electrical resistance in correspondence with physical deformation of electrode 280 enables a sensor element signal to be generated that is indicative of deformation of the electrode. The elastomeric electrodes typically comprise a flexible elastomer material (e.g., silicone, rubber) impregnated with conductive particles, such as aluminum, copper, carbon (e.g., graphite), or the like.

Each capacitive sensor element 270 typically has an area that is selected in the design process so that capacitive ranging sensing system 200 can provide a desired distance-sensing sensitivity. For example, ranging system 200 that is adapted for use in sensing human anatomy, such as is used in an x-ray imager, the area of each sensor element 270 is typically in the range between about 1 $cm^2$ (e.g., in an arrangement having a large number (50–75) of sensor plates 270) and 100 $Cm^2$ (e.g., in an arrangement having a few (e.g., 4) large plates in collar assembly 130). Segments of elastomeric electrodes 280 comprise between at least 1% and 95% of the area of each sensor element 270, commonly, to provide adequate spacing for electrode deformation and ease of fabrication, the electrodes comprise between about 25% and 75% of the sensor area (e.g., as shown in FIG. 2). Each sensor element comprises two or more elastomeric electrode segments 280; by way of illustration and not limitation, as illustrated in FIG. 2, each sensor element 270 comprises first, second, third, and fourth electrode segments 281, 282, 283, 284. The electrode segments in each respective sensor element 270 are electrically coupled together in series, with first electrode segment 281 being coupled to the respective element first electrical lead 272 and fourth electrode segment 284 being coupled to capacitive sensing element second electrical lead 274. The area of each sensor element 270 is defined by the area between first electrical lead 272 and second electrical lead 274.

Sensor elements 270 are typically disposed in the interior of the circular tube-like structure of collar assembly 130. Collar assembly typically has a surface structure 132 comprising a pliable material, such as rubber or soft plastic (in use, commonly a further sterile covering of plastic or the like is disposed across the collar assembly to protect against spread of infection in the event of inadvertent contact of collar assembly with a patient). Sensor elements 270 are typically disposed so as to conform with the curved surface structure 132 of the tube-like collar assembly 130 so that any contact between surface structure 132 and subject 50 that results in deformation of the pliable surface structure 132 similarly causes a deformation of one or more electrode segments 280 disposed on the interior side of the surface structure 132. Such a structure can be readily fabricated by the deposition and patterning of elastomeric electrode material on the interior side of curved surface structure 132.

Sensor plate elements 270 are disposed around donut-shaped collar assembly 130 in a sensing pattern 275 as illustrated in FIG. 2. The sensing pattern is selected such that sensor plate elements 270 extend circumferentially, typically at equiangular intervals, over a large portion of the collar assembly area so that the proximity detection system can provide accurate ranging information of a subject and localization (with respect to a position on collar assembly 130) of any contact between subject 50 and collar assembly 130. The size of individual sensor elements 270 and the total number of elastomeric electrode segments 280 in each sensor element are selected in the design process as noted above; by way of example and not limitation, a collar assembly 130 used in an x-ray imager applications may have an outer diameter in the range of about 10 cm to about 40 cm, and may have between about 4 and 75 sensor plates 270 disposed therein, which plates may have an area in the range between about 1 $cm^2$ and 100 $cm^2$, with each sensor element 270 having between about 2 and 200 elastomeric electrodes 280. Different size of plates may be selected to provide a desired range and resolution capability for imager control system 200; the sensitivity of range sensing system 200 corresponds to the area of electrically respective sensor elements 270 (that is, the area of plates that are electrically coupled together via multiplexer 220 so as to electrically comprise the equivalent of a single plate) and the area of the subject being sensed, and resolution is enhanced by having a sufficient small plates disposed around collar assembly 130 so as to be able to localize contour features of subject 50.

Each sensor element 270 is respectively electrically coupled via multiplexer 220 to processor 250 to enable electrical signals corresponding to the proximity of subject 50 to individual sensor elements 270 to be processed. Multiplexer 220 comprises switching circuits 225 (comprising, for example, rotary switches, semiconductor integrated circuit multiplexers, or the like) that selectively couple sensor elements 270 in contact localization sensing arrangements (that is, groups of sensor elements 270 coupled together) to processor 250.

Processor 250 comprises contact detection circuits 252 that are adapted to detect a change in the electrical resistance of electrode segments 280 in sensor elements 270 coupled together via multiplexer 220 in contact localization sensing arrangements. Contact detection circuit 252 typically further comprises a memory device (e.g., microchip programmed for measurement and storage of electrical resistance data) that periodically (e.g., during a maintenance period with known conditions on collar assembly 130) measures and records baseline resistance values for each sensor element 270 in collar assembly 130. Resistance measurements made during operation of the imager can then be compared against these baseline (or reference values) to determine the location of a deformed sensor element exhibiting a changed resistance as a result of contact with subject 50.

In operation, detection of changes in resistance can be accomplished in a variety of ways. For example, contact detection circuit 252 is electrically coupled to sensors via multiplexer 220 and to ground potential. Initially, all sensors 270 are coupled together in series (in a first contact localization sensing arrangement) with a low frequency (e.g., 1 KHz or less) or DC voltage applied. If a resistance change is detected, multiplexer 220 switches to a second contact localization sensing arrangement comprising fewer sensor elements 270 coupled together in series to determine in which of the second contact localization sensing arrangements the non-baseline resistance exists. By progressively multiplexing to smaller contact localization sensing arrangements, the location of contact (and hence the deformed sensor exhibiting the non-baseline resistance) can be determined. Commonly, the multiplexing is done to form respective contact localization sensing arrangements of one-half the sensors 270 then one-quarter the sensors, and so forth down to individual sensor elements. This multiplexing can further be combined with capacitive range sensing as noted above, with multiplexed 220 and processor 250 further periodically shifting between contact sensing and ranging modes of operation.

In operation, ranging system 200 generates signals corresponding to the detected range between subject 50 and collar assembly 130 as gantry arm 110 is maneuvered around subject 50 for imaging operations. In the event of contact between collar assembly 130 and subject 50, a portion of the pliable surface 132 of collar assembly 130 is deformed (e.g., pushed in slightly). One or more elastomeric electrode segments 180 disposed on the interior of the collar assembly surface 132 are similarly deformed (that is, changed in physical dimensions) as a result of the deformation of collar assembly surface 132. Contact detection circuits 252, which is coupled via multiplexer 220 to sensor elements 270 coupled together in sensing modality switching units so as to measure the electrical resistance of the sensor elements, detects contact with the collar assembly as a result in the changed resistance (without any commanded change in the number of sensor elements coupled together in a respective sensing modality switching unit). Contact detection circuit 252 can then generate a signal to multiplexer unit 220 to switch to progressively smaller groupings of sensor elements 270 in sensing modality switching units, down to individual sensor elements, so that the point (or points) of contact between collar assembly 130 and subject 50 can be identified. A subject contact signal is then generated by processor 250 in correspondence with the location of one or more sensor elements 270 having elastomeric electrodes 280 deformed (and hence having other than baseline electrical resistance readings) so that control console 210 can then generate control signals to move gantry arm assembly 110 away from contact with subject 50.

It will be apparent to those skilled in the art that, while the invention has been illustrated and described herein in accordance with the patent statutes, modifications and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A ranging system for positioning a movable arm having an imaging system component disposed thereon with respect to a subject, the ranging system having subject contact detection capability and comprising:

a collar assembly disposed around at least a portion of said imaging system component disposed towards a subject region;

a plurality of sensor elements disposed in a sensing pattern in said collar assembly, each sensor element comprising a plurality of segments of elastomeric electrodes electrically coupled together in series;

a processing unit further comprising a multiplexer, said multiplexer being coupled to each of said sensor elements to selectively electrically couple said sensor elements in one of a plurality of contact localization sensing arrangements, each of said contact localization sensing arrangements comprising at least one of said sensor elements, said processing unit being coupled to said sensor elements via said multiplexer so as to generate a subject contact signal in correspondence with an electrical signal passing from respective sensor element elastomeric electrodes, said electrical signal varying in correspondence with changes in the electrical resistance of said elastomeric electrodes resulting from deformation of said elastomeric electrodes in said sensor elements, said contact signal further providing contact location in said sensing pattern around said collar assembly.

2. The ranging system of claim 1 wherein said elastomeric electrodes comprises an electrically resistive material having an electrical resistance that is a function of physical deformation of the elastomeric electrode.

3. The ranging system of claim 2 wherein said elastomeric electrodes comprise a conductive material embedded in a flexible material selected from the group consisting of silicones and rubber.

4. The ranging system of claim 1 wherein said ranging system is coupled to an x-ray imaging system so as to detect contact between said collar assembly and the subject of the x-ray imaging system.

5. The ranging system of claim 1 wherein said multiplexer comprises switching circuits to which said sensor elements are coupled to selectively provide one of said plurality of contact localization sensing arrangements;

said plurality of contact localization sensing arrangements comprising respective groups consisting of a single sensor element, pluralities less than the total number of sensor elements disposed in said collar assembly of sensor elements electrically coupled together, and all sensor elements in said collar assembly electrically coupled together.

6. The ranging system of claim 5 wherein said processing unit further comprises a contact detection circuit for measuring the electrical resistance of respective ones of said contact localization sensing arrangements and comparing the measured resistance with a baseline electrical resistance value.

7. The ranging system of claim 1 wherein said sensor elements are disposed so as to conform with the shape of the surface of said collar assembly.

8. The ranging system of claim 7 wherein each of said sensor elements comprises between about 2 and about 200 of said elastomeric electrode segments.

9. The ranging system of claim 7 wherein said elastomeric electrodes in each of said sensor elements comprise an area between about 1% and 95% of the total area of said capacitive sensor element.

* * * * *